US009368880B2

(12) United States Patent
Solondz

(10) Patent No.: US 9,368,880 B2
(45) Date of Patent: Jun. 14, 2016

(54) MULTI-SECTOR ANTENNA STRUCTURE

(71) Applicant: Max Solondz, New Vernon, NJ (US)

(72) Inventor: Max Solondz, New Vernon, NJ (US)

(73) Assignee: Alcatel Lucent, Boulogne-Billancourt (FR)

( * ) Notice: Subject to any disclaimer, the term of this patent is extended or adjusted under 35 U.S.C. 154(b) by 534 days.

(21) Appl. No.: 13/679,059

(22) Filed: Nov. 16, 2012

(65) Prior Publication Data

US 2014/0139395 A1 May 22, 2014

(51) Int. Cl.

| | |
|---|---|
| ***H01Q 21/28*** | (2006.01) |
| ***H01Q 1/24*** | (2006.01) |
| ***H01Q 21/08*** | (2006.01) |

(52) U.S. Cl.

CPC ..... *H01Q 21/28* (2013.01); *H01Q 1/246* (2013.01); *H01Q 21/08* (2013.01)

(58) Field of Classification Search

CPC ..... H01Q 1/42; H01Q 21/28

USPC ..... 343/872

See application file for complete search history.

(56) References Cited

U.S. PATENT DOCUMENTS

| | | | | |
|---|---|---|---|---|
| 6,259,419 | B1 * | 7/2001 | Monte | 343/890 |
| 6,314,305 | B1 | 11/2001 | Solondz et al. | |
| 2009/0312057 | A1 | 12/2009 | Moon et al. | |
| 2010/0093345 | A1 * | 4/2010 | Verhoef et al. | 455/433 |
| 2010/0315978 | A1 * | 12/2010 | Satapathy et al. | 370/294 |

FOREIGN PATENT DOCUMENTS

| | | | |
|---|---|---|---|
| EP | 0856910 | A2 | 8/1998 |

OTHER PUBLICATIONS

International Search Report and Written Opinion dated Feb. 7, 2014 for related International Application No. PCT/US2013/069169.

* cited by examiner

*Primary Examiner* — Dameon E Levi
*Assistant Examiner* — Andrea Lindgren Baltzel
(74) *Attorney, Agent, or Firm* — Harness, Dickey & Pierce, P.L.C.

(57) ABSTRACT

A multiple sector cell-site antenna includes a first antenna oriented to serve a first sector, the first antenna electrically connected to a first transceiver group; a second antenna oriented to serve a second sector adjacent to the first sector, the second antenna electrically connected to the first transceiver group; and a single enclosure covering both the first antenna and the second antenna. By providing at least two multiple sector cell-site antennas in a system, the total number of enclosures is reduced while providing redundancy and diversity within the cells.

16 Claims, 8 Drawing Sheets

MULTI-SECTOR ANTENNA STRUCTURE

BACKGROUND OF THE INVENTION

1. Field

Embodiments relate to a multi-sector antenna, a multi-band multi-sector antenna, and systems including the same.

2. Related Art

In a wireless telecommunications system, a geographic area serviced by the wireless telecommunications system is divided into spatially distinct areas called "cells". Cells are typically further divided into multiple 'sectors'. For example, often each of the cells are divided into three equal area sectors. Typically, each cell contains a base transceiver station (BTS) that uses transceivers (TRXs) and antennas to facilitate wireless communication between user equipment (UE) and a network. The transceivers may include one or more receivers and transmitters and may be packaged in a Remote Radio Heads (RRHs). A RRH generally contains two or more transceivers that are each connected to a duplex filter, thus enabling each transceiver to support simultaneous downlink transmission and uplink reception via a single antenna.

A BTS may also be referred to as a radio base station (RBS), node B (in 3G Networks) or, simply, a base station (BS). Examples of UEs include devices like mobile phones, computers with wireless Internet connectivity, and other devices. The network can be any wireless communication network (e.g., GSM, CDMA, etc.).

The antennas may be housed in an enclosure that protects the antennas from environmental conditions or conceals the antenna's electronic equipment from public view. The enclosure may be referred to as a "radome". The enclosure is often constructed of a material that is transparent to radio waves and inhibits icing from accumulating on its surface. For instance, the enclosure may be made of a fiberglass material.

Basic Antenna

The simplest antenna technology is a single input, single output (SISO) antenna, which refers to a wireless communications system in which one antenna is used for transmission (e.g., a single 'input' into the transmission channel) and one antenna is used for reception (e.g., a single 'output' out of the transmission channel). The transmission channel may be a downlink channel (from the BTS's transmitter(s) to the UE's receiver(s)) or an uplink channel (from the UE's transmitter(s) to the BTS's receiver(s)). While relatively simple to design, SISO systems are vulnerable to problems caused by multipath fading effects.

Multipath fading effects result when an electromagnetic field (EM field) meets obstructions such as hills, canyons, buildings, and utility wires, which results in the EM field scattering (reflecting), and thus taking multiple paths to reach its destination, resulting in random phase shifts between the multiple signal paths. When a source sends a Radio Frequency (RF) signal that encounters scattering, the recombination of the multiple RF paths' signals with various phases causes Rayleigh fading effects. When the signals combine into one signal at the receiving antenna, because the signals are out of phase, the effective signal is attenuated. When the attenuation is severe, the signal may be below the receiver's minimum discernible signal level, and the receiver may not be able to successfully receive and decode the original signal. In a wireless telecommunications system, such multipath fading can cause a reduction in coverage area, a reduction in achievable data speeds and an increase in the number of errors in processing the signal.

Diversity

To avoid multipath fading effects, systems are available to improve signal quality by using a plurality of antennas in combination with diversity techniques. Diversity techniques can be used to combine the signals received from the multiple antennas, drastically reducing the probability of fading, because both antennas likely will not experience simultaneous severe fading attenuation.

Diversity techniques can be used for reception and/or transmissions from the multiple antennas. Various terminology is used to describe different diversity techniques. For example, a single input, multiple output (SIMO) technique (uplink or downlink) refers to a diversity technique having a single transmitter antenna (single input) and multiple reception antennas (multiple output) (also known as diversity reception) utilizing any number of separate reception antennas. A multiple input, multiple output MIMO technique (uplink or downlink) refers to a technique including both multiple transmitter antennas (multiple coded transmission signals) and multiple reception antennas.

The multiple reception antennas may provide two-way diversity or four-way diversity depending on the number of independent (or decorrelated) signals provided from the separate antennas.

Each of the multiple antennas used to provide the separate diverse signals can contain multiple antenna elements (e.g., dipole elements). In dipole antennas, a plurality of polarized dipole elements (typically, four to ten elements) are equally spaced and vertically stacked to achieve directivity (antenna gain), thus each antenna may actually be an array of antenna elements. The dipoles may be arranged such that the antenna is either a linear dipole antenna (one element) or dual slant/cross-polarized dipole antenna (twin elements located together).

FIG. 1 illustrates different linear dipole antenna array arrangements.

As illustrated in FIG. 1, in a linear array of dipole antennas 100, the dipole elements are all of the same polarization. These dipole elements may be arranged in an array of vertically polarized dipole elements 110. Alternatively, the dipole elements may be arranged in an array of horizontally polarized dipole elements 120. In antenna arrays that utilize linear arrays of dipole elements, all of the dipole elements receive the same polarization and thus having the same fading behavior (e.g., correlated fading statistics). Therefore to achieve sufficient diversity (independent fading statistics), multiple discrete linear dipole antenna arrays are spaced a distance apart in a technique known as a space diversity (horizontal spatial separation of the antennas).

In space diversity, the antennas are spaced a sufficient horizontal distance apart to ensure that the Rayleigh fading that each array experiences will be independent (decorrelated). In more detail, because of the different physical location of the arrays, the phases of the signals traveling different paths that are recombined are different enough that the apparent fading will be different. However, the minimum distance required between the antenna arrays to ensure independent fading effects is on the order of seven to ten lambda $\lambda$ (where $\lambda$ is the wavelength of the RF signal). This minimum distance between the antenna arrays makes the use of a single integrated structure, such as a radome, to house the two antenna arrays impractical because a structure of such size may be visually imposing, heavy and may create a large surface area that is susceptible to wind loading. Therefore, the installation of multiple antenna arrays using spatial diversity generally requires multiple structural enclosures (e.g., separate radomes) resulting in increased costs and more complex installations when compared to single enclosures.

FIGS. 2A and 2B illustrate a conventional antenna installation utilizing space diversity.

As illustrated in FIG. 2A, a conventional antenna structure is mounted on a cellular boom 250 to achieve spatial diversity. FIG. 2B is a three-dimensional view of the conventional antenna structure of FIG. 2A. In the conventional antenna structure, to achieve spatial diversity, a first antenna array 210*a* and a second antenna array 210*b* are mounted on the face of the cellular boom 250 and separated from each other by a distance D, where the distance D is a distance sufficient to achieve sufficient spatial diversity between the two antenna arrays 210/210*b*. The required separation distance D (e.g., seven to ten lambda λ), may make the use of a single integrated structure to house both the first antenna array 110*a* and the second antenna array 110*b* impractical. Therefore, in the conventional antenna structure to obtain spatial diversity, the first antenna array 210*a* is protected by a first enclosure 230*a* and the second antenna array 210*b* is protected by the second enclosure 230*b*.

To eliminate the need for spacing between the two antenna arrays, and thus separate enclosures, as required for a diversity scheme that utilizes linear dipole antennas, while still achieving adequate decorrelation, cross-polarized dipole antennas may be used.

FIG. 3 illustrates different various cross-polarized antenna array arrangements.

As illustrated in FIG. 3, in cross-polarized antennas 300, the elements that make up the antenna array are orthogonally polarized in a scheme known as polarization diversity. In polarization diversity, two-way diversity is achieved by pairing two complementary polarized antenna elements together into a single structure.

In the cross-polarized antenna array the dual polarized elements may be a dual slant cross polarized antenna 310, in which the polarized elements cross each other in a slant (e.g., +45 degrees and −45 degrees). Alternatively, the array of dual polarized elements may be a vertical/horizontal cross polarized antenna 320 in which the polarized elements cross each other vertically and horizontally. In additional to dual-slant and vertical/horizontal cross-polarized antennas, the dual polarized elements may be arranged to provide circular polarization (not shown). The circular polarization may be either right hand circular polarization (RHCP) or left hand circular polarization (LHCP). Each of the polarized elements in the cross-polarized stack of elements has a port, resulting in the cross-polarized antenna array having two ports (e.g., connections), a first port 340 for one polarization and a second port 350 for the other polarization. The cross-polarized antenna configuration provides two-way diversity without requiring the large spatial separation of the antenna arrays that is required in spatial diversity. Thus, the two sets of antenna elements may be packaged together in one structure, eliminating the requirement for multiple separate antenna structures.

Dual polarized antennas provide only two-way diversity, because there are only two orthogonal polarizations. If four-way diversity is desired, a pair of cross-polarized antennas may be required to achieve both spatial diversity and polarization diversity. The minimum horizontal spacing between the pair of cross-polarized antennas necessary to achieve adequate spatial diversity may again require a system having multiple structural enclosures in order to be practical.

SUMMARY OF THE INVENTION

At least one example embodiment relates to a multiple sector cell-site antenna.

In one embodiment, the multiple sector cell-site antenna includes a first antenna oriented to serve a first sector, the first antenna electrically connected to a first transceiver group; a second antenna oriented to serve a second sector adjacent to the first sector and the second antenna electrically connected to the first transceiver group; and a single enclosure covering both the first antenna and the second antenna.

In one embodiment, the first transceiver group is integrated in the single enclosure.

In one embodiment, the single enclosure includes antenna input/output ports to connect the first antenna and the second antenna to the first transceiver group.

In one embodiment, the first antenna and the second antenna are each an array of antenna elements.

In one embodiment, the first transceiver group is a Remote Radio Head (RRH) and includes at least four ports, the first antenna is a first dual-polarized antenna electrically connected to two of the at least four ports, and the second antenna is a second dual-polarized antenna electrically connected to two of the at least four ports.

In one embodiment, the first antenna and the second antenna are each one of an array of dual-polarized dual-slant antenna elements, an array of dual-polarized vertical/horizontal dipole antenna elements and an array of dual-polarized right-hand/left-hand polarized antenna elements.

In one embodiment, the single enclosure is a radome and the first antenna and the second antenna meet to form a first corner.

In one embodiment, the multiple sector cell-site antenna includes a pivot point located on the enclosure at the first corner, the pivot point configured to adjust an angle between the first antenna and the second antenna based on a number of sectors in the cell-site.

In one embodiment, the pivot point is configured to incrementally adjust the angle between one of 120 degrees, 90 degrees and 60 degrees.

At least one example embodiment relates to a multiple sector cell-site antenna system.

In one embodiment, the multiple sector cell-site antenna system includes a first multiple sector cell-site antenna and a second multiple sector cell-site antenna. The first multiple sector cell-site antenna includes a first antenna oriented to serve a first sector, the first antenna electrically connected to a first transceiver group; a second antenna oriented to serve a second sector, the second sector adjacent to the first sector, the second antenna electrically connected to the first transceiver group; and a first enclosure covering both the first antenna and the second antenna. The second multiple sector cell-site antenna includes a third antenna oriented to serve the first sector, the third antenna electrically connected to a second transceiver group; a fourth antenna oriented to serve a third sector, the fourth antenna electrically connected to the second transceiver group; and a second enclosure covering both the third antenna and the fourth antenna.

In one embodiment, the first transceiver group is integrated in the first enclosure and the second transceiver group is integrated in the second enclosure.

In one embodiment, the first enclosure includes antenna input/output ports configured to connect the first antenna and the second antenna to the first transceiver group and the second enclosure includes antenna input/output ports to connect the third antenna and the fourth antenna to the second transceiver group.

In one embodiment, each of the antennas are an array of antenna elements.

In one embodiment, the first multiple sector cell-site antenna and the second multiple sector cell-site antenna are spatially separated by a distance such that spatial diversity against fading is provided for the first sector.

In one embodiment, the first transceiver group is a first Remote Radio Head (RRH) and the second transceiver group is a second RRH and each RRH each include at least four ports. The first antenna is a first polarized antenna electrically connected to two of the at least four ports of the first RRH and the second antenna is a second polarized antenna electrically connected to two of the at least four ports of the first RRH. The third antenna is a third polarized antenna electrically connected to two of the at least four ports of the second RRH and the fourth antenna is a fourth polarized antenna electrically connected to two of the at least four ports of the second RRH.

In one embodiment, the first antenna that is connected to the first transceiver group and third antenna that is connected to the second transceiver group together utilize antenna cross connect to provide redundancy and diversity to the first sector.

In one embodiment, the first antenna and second antenna meet to form a first corner and the third antenna and fourth antenna meet to form a second corner. The first enclosure includes a first pivot point at the first corner, the first pivot point configured to adjust an angle between the first antenna and the second antenna based on a number of sectors in the cell-site. The second enclosure includes a second pivot point at the second corner, the second pivot point configured to adjust an angle between the third antenna and the fourth antenna based on the number of sectors in the cell-site.

At least one example embodiment relates to multiple-band multiple-sector cell-site antenna.

In one embodiment, the multiple-band multiple-sector cell-site antenna includes a first high-band antenna, a second high-band antenna, a first low-band antenna and a single enclosure covering the first high-band antenna, the second high-band antenna, and the first low-band antenna. The first high-band antenna is configured to utilize a first radio wave band and oriented to serve a first sector, the first high-band antenna electrically connected to a first high-band transceiver group. The second high-band antenna is configured to utilize the first radio wave band and oriented to serve a second sector adjacent to the first sector, the second high-band antenna electrically connected to the first high-band transceiver group. The first low-band antenna configured to utilize a low radio wave band and oriented to serve the first sector, the low-band antenna electrically connected to a low-band transceiver group.

In one embodiment, each of the antennas are an array of dual-polarized antenna elements that provide two-way diversity for one or more of uplink reception of signals and downlink transmission of signals.

BRIEF DESCRIPTION OF THE DRAWINGS

The present invention will become more fully understood from the detailed description given herein below and the accompanying drawings, wherein like elements are represented by like reference numerals, which are given by way of illustration only and thus are not limiting of the present invention and wherein.

Figure 1:
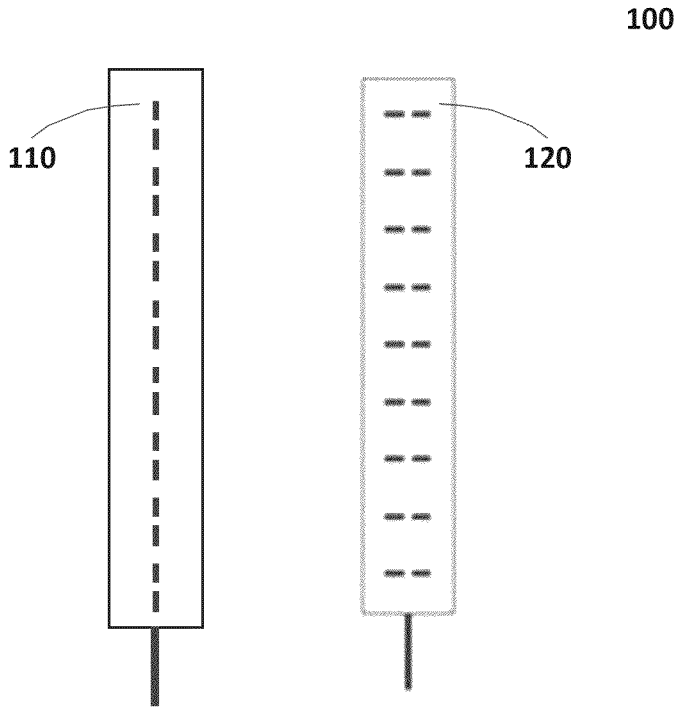
FIG. 1 illustrates different linear dipole antenna array arrangements.

It should be noted that these Figures are intended to illustrate the general characteristics of methods, structure and/or to merely illustrate the certain example embodiments and to supplement the written description provided below. These drawings are architectural block diagrams of the system, and are not, however, to scale and may not precisely reflect the precise structural or mechanical characteristics of any given embodiment, and should not be interpreted as defining or limiting the range of values or properties encompassed by example embodiments. For example, the relative sizes and positioning of the arrays, and/or structural elements may be reduced or exaggerated for clarity. The use of similar or identical reference numbers in the various drawings is intended to indicate the presence of a similar or identical element or feature.

DETAILED DESCRIPTION OF THE EMBODIMENTS

While example embodiments are capable of various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the claims. Like numbers refer to like elements throughout the description of the figures.

Methods discussed below may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a storage medium. A processor(s), Field Programmable Gate Array (FGPA) or an Application Specific Integrated Circuit (ASIC) may perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

It should also be noted that in some alternative implementations, the functions/acts noted may occur out of the order noted in the figures. For example, two figures shown in succession may in fact be executed concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description are presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments will be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Note also that the transmission medium may be twisted wire pairs, coaxial cable, optical fiber, or some other suitable transmission medium known to the art. The example embodiments not limited by these aspects to any given implementation.

In one or more example embodiments, a structural enclosure includes at least two antennas that are each configured to serve two adjacent separate sectors from one common location, for example, from a 'corner' where two adjacent sectors meet. A system including an arrangement of at least two structural enclosures provides diversity and redundancy, while reducing the total number of structural enclosures by at least half in comparison to a conventional arrangement, thus reducing cost and installation complexity.

Figure 4A:
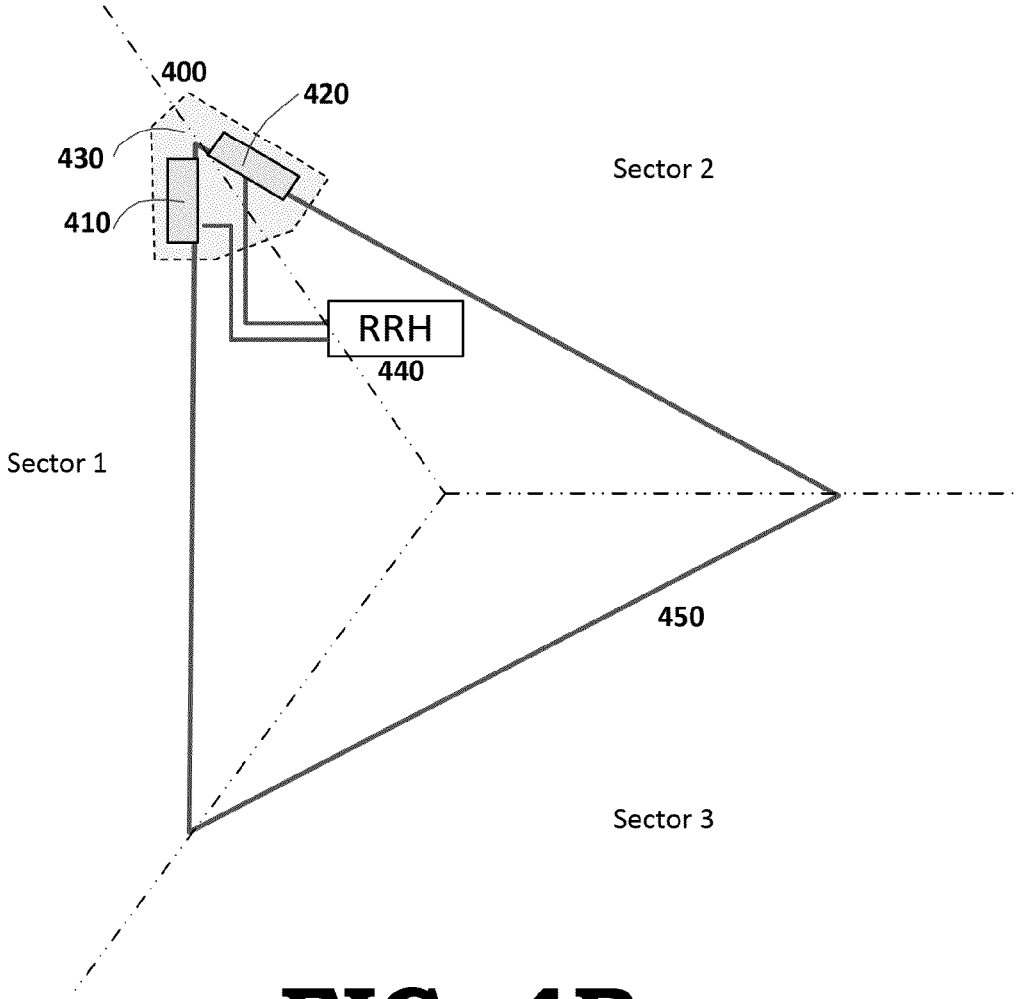
FIG. 4A illustrates a multi-sector antenna structure utilizing antenna cross connect according to an example embodiment.

FIG. 4A illustrates a multi-sector antenna structure utilizing Antenna Cross Connect (ACC) according to an example embodiment.

In FIG. 4A, a multi-sector antenna structure 400 includes at least a first antenna 410, a second antenna 420, a structural enclosure 430, a first transceiver group (e.g., a set of transceivers) within an RRH 440 and a cellular boom 450. The first antenna 410 may be an array of first elements and the second antenna 420 may be an array of second elements. The antennas are configured to provide both downlink transmission and uplink reception of signals to and from at least two adjacent sectors from one common location using the RRH 440, for example, from a 'corner' where the two adjacent sectors meet. Rather than arranging the antenna arrays to face a same direction and serve the same sector, the at least two antenna arrays 410/420 are each configured to serve a different sector by arranging the arrays to serve the sectors from the 'corners', with each array pointed differently to serve one of the at least two adjacent sectors. For example, the first antenna array 410 faces (and serves) Sector 1 and the second antenna array 420 faces (and serves) Sector 2.

The RRH 440 includes a first transceiver group (e.g., a plurality of receivers and transmitters) (not shown). The receivers convert received signals from RF signals to digital signals that are conveyed to a Base-Band Unit (BBU) (not shown) over a Common Public Radio Interface (CPRI). The digital signals are often optic signals and the BBU is often located a significant distance from the RRH 440. Likewise, the transmitters transmit radio frequency (RF) signals conveyed from the BBU to user equipments (UEs) (not shown) located within the sector. The RRH 440 may include one or more transceivers.

Antenna Cross Connect

Figure 4B:
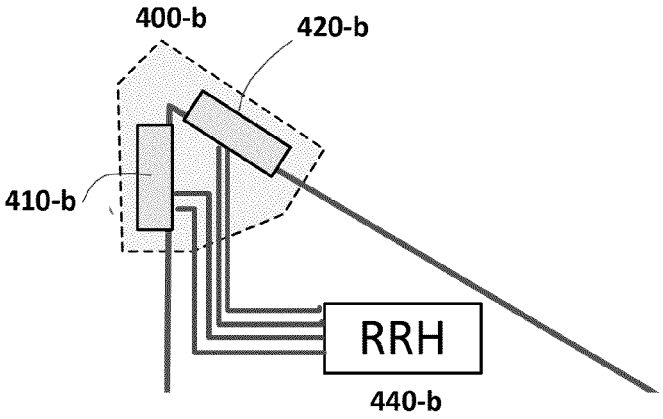
FIG. 4B illustrates a multi-sector antenna structure having dual-port cross-polarized antennas according to an example embodiment.

Conventionally, each RRH controls transmission and reception within the sector from one or more antennas. However, failure of an RRH may result in a signal outage within the sector. In contrast, as shown in FIGS. 4A and 4B, in one or more example embodiments the RRH 440 is connected to antenna arrays that serve different sectors, namely the first antenna array 410 serving Sector 1 and the second antenna array 420 serving Sector 2 in a scheme known as Antenna Cross Connect (ACC). In ACC, multiple RRHs are connected to antennas used to support adjacent sectors. Thus, if any one RRH fails, there remains RRHs and antennas that can continue to serve the sector. Thus, while coverage may be degraded because of the loss of multiple antennas per sector (loss of diversity reception or MIMO transmission), coverage is not completely lost.

The antenna arrays 210/220 may be single port linear antenna arrays (for SISO uplink reception or SIMO downlink transmission). For instance, each of the antenna arrays 210/220 may be an antenna array 110 or an antenna array 120 as illustrated in FIG. 1.

Figure 3:
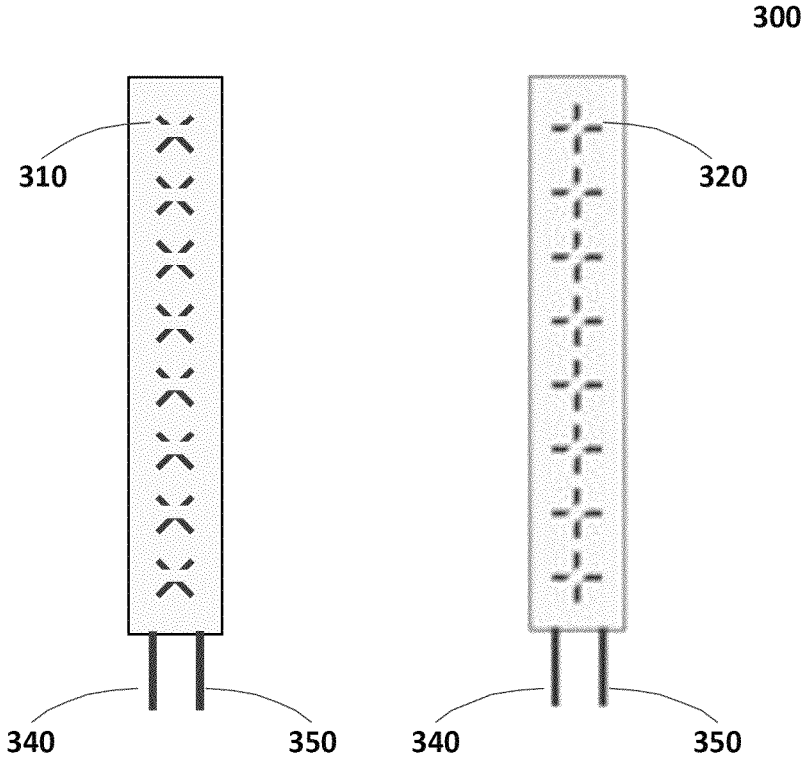
FIG. 3 illustrates different cross-polarized antenna array arrangements.

Likewise, the antenna arrays may be dual polarization dual port antennas in which cross-polarized antennas are used at the BS for uplink reception from the sector of interest or downlink transmission to the sector of interest. For instance, each of the antenna arrays may have cross-polarized antenna elements 310 or 320, as illustrated in FIG. 3.

FIG. 4B illustrates a multi-sector antenna structure 400-*b* having dual-port cross-polarized antennas according to an example embodiment.

As illustrated in FIG. 4B, the antenna structure 400-*b* has a same structure as the multi-sector antenna structure 400 except the antenna arrays 410-*b*/420-*b* are dual-port cross-polarized antennas where each antenna array 410-*b*/420-*b* is a pair of cross-polarized antenna arrays, resulting in the RRH 440-*b* being connected to each antenna array 410-*b*/420-*b* via a pair of electrical connections. Therefore, while the RRH 440 of FIG. 4A is shown connected to each of the antenna arrays 410/420 via a single connection, the RRH 440-*b* in FIG. 4B is connected to each of the antenna arrays 410-*b*/4200*b* via a pair of electrical connections, one for each array of the polarized antenna elements in the antenna array. By utilizing cross-polarized antennas, two-way diversity can be achieved from each antenna structure 400-*b* by pairing two complementary polarized antenna elements together in a single antenna. Because the multi-sector antenna structure 400-*b* is a dual-port cross-polarized antenna, the multi-sector antenna structure 400-*b* may support two antenna port connections.

The structural enclosure 430 may be made of a material that is transparent to the RF signals and has mechanical properties making the enclosure substantially strong, waterproof and resistant to icing. In some example embodiments, the RRH 440 may be external to the structural enclosure 430 and therefore the structural enclosure 430 may include ports on the surface thereof to connect the RRH 440. In other example embodiments, the structural enclosure 430 may have the RRH 440 integrated therein. The shape of the structural enclosure may be dictated by the design of the cell, such as whether the cell is a 3-sector, 4-sector, or 6-sector cell and whether the structural enclosure 430 has the RRH 440 integrated therein.

Figure 5A:
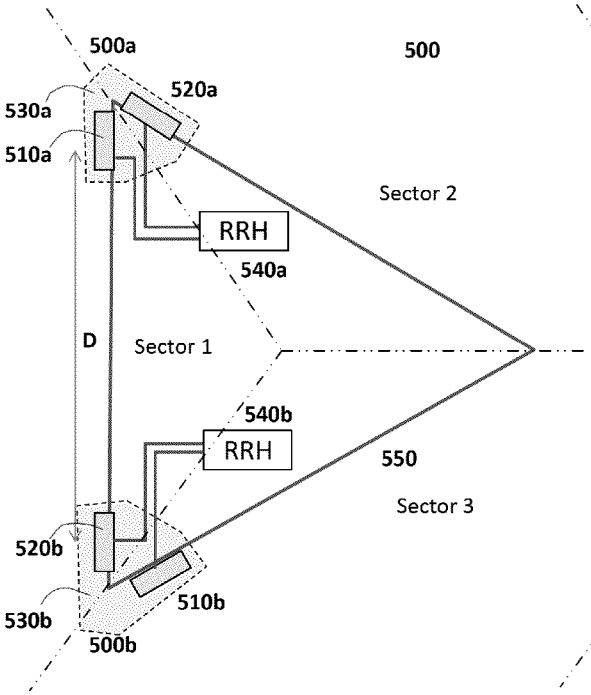
FIG. 5A illustrates a system containing at least two multi-sector antenna structures configured to achieve two-way diversity according to an example embodiment.
Figure 5B:
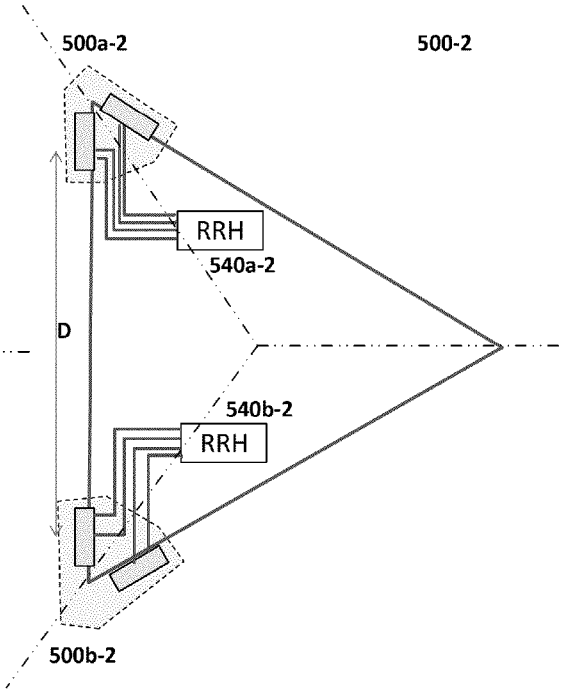
FIG. 5B illustrates a system containing at least two multi-sector antenna structures configured to achieve four-way diversity according to an example embodiment.

FIGS. 5A and 5B illustrate systems containing at least two multi-sector antenna structures according to example embodiments.

As shown in FIG. 5A, a system 500 may include a cellular boom 550, at least a first multi-sector antenna structure 500*a* and a second multi-sector antenna structure 500*b* mounted thereto. Each of the multi-sector antenna structures 500*a*/500*b* has a same structure as the multi-sector antenna structure 400. For instance, each of the multi-sector antenna structures 500*a*/500*b* contains at least two antenna arrays that each serve separate adjacent sectors and are both connected to the same RRH (e.g. transceiver group). Therefore, the first multi-sector antenna structure 500*a* includes a first RRH 540*a* that simultaneously serves at least a first sector (Sector 1) via a first antenna array 510*a* and a second sector (Sector 2) via a second antenna array 520*a*. Likewise, the second multi-sector antenna structure 500*b* includes a second RRH 540*b* that simultaneously serves at least the first sector via a first antenna 520*b* and a third sector via a second antenna 510*b*. If the signals are conveyed appropriately to the Base Band Unit (BBU) using ACC, each sector is served by at least two RRHs. For example, the first sector (Sector 1) is served by antenna 510*a* connected to RRH 540*a*, and by antenna 520*b* connected to RRH 540*b*.

Each RRH can transmit/receive appropriate signals to/from two adjacent sectors. This results in each sector being served by at least two RRHs, thus providing redundancy in each of the sectors. For instance, the first sector is being served by RRH 540*a* and RRH 540*b*.

Figure 2A:
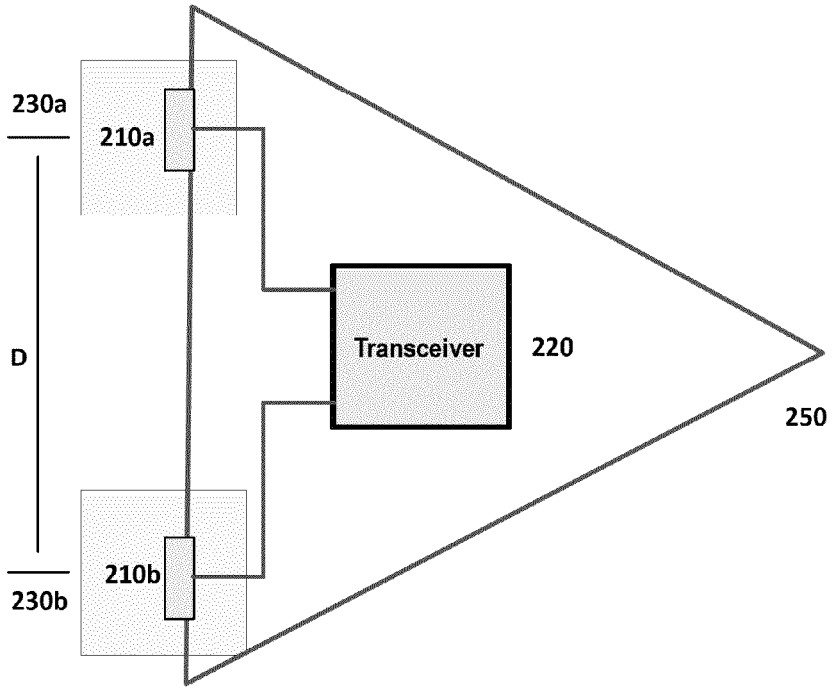
FIGS. 2A and 2B illustrate a conventional antenna installation utilizing space diversity.
Figure 2B:
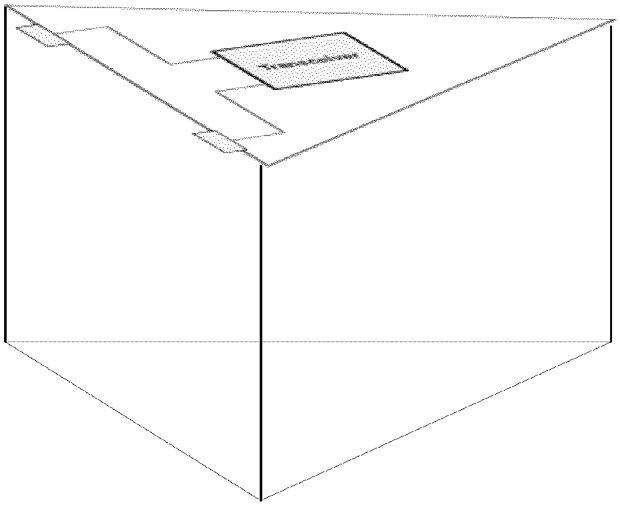

Additionally, two way diversity may be achieved upstream at the BBU, if each of the at least two multi-cell antenna structures 500*a*/500*b* are sufficiently spaced a horizontal distance D (e.g., seven to ten lambda λ). In contrast to the conventional example of spatial diversity illustrated in FIG. 2A, in the example embodiment illustrated in FIG. 5A, spatial diversity can be achieved while minimizing the size and the number of structural enclosures 530*a*/530*b*.

Likewise, if the antenna arrays in each of the at least two multi-cell antenna structures are cross-polarized antennas, polarization diversity may be provided to each sector. Thus, providing four receive signals and/or four transmit signals (depending on whether the antennas are SIMO or MIMO) resulting in four-way diversity.

FIG. 5B illustrates a system 500-2 containing at least two multi-sector antenna structures configured to achieve four-way diversity according to an example embodiment.

As illustrated in FIG. 5B, a system 500-2 has the same structure as the system 500 except, the system 500-2 contains multi-cell antenna structures 500*a*-2/500*b*-2, which in addition to being sufficiently spaced to achieve spatial diversity, each include cross-polarized antennas. By including cross-polarized antennas in the system 500-2 four-way diversity may be achieved upstream at the BBU (not shown).

As illustrated in FIG. 5B, the multi-cell antenna structures 500*a*-2/500*b*-2 have the same structure as the multi-cell antenna structures 500*a*/500*b* illustrated in FIG. 5A except that the multi-cell antenna structures 500*a*-2/500*b*-2 antenna's may have the antenna structure illustrated in FIG. 4B, where each antenna array is a pair of cross-polarized antenna elements and the RRHs 540*a*-2/540*b*-2 are each connected to respective antenna arrays via a pair of electrical connections. Thus, each RRH 540*a*-2/540*b*-2 has two pairs of ports connected a respective one of the antenna structures 500*a*-2/500*b*-2. Thus four-way diversity can be achieved in each sector by creating spatial diversity between a pair of cross-polarized antennas.

Additional multi-cell antenna structures may be similarly arranged adjacent to the multi-sector antenna structures (500*a*/500*b*) in the system 500, with half of each additional structure's antennas serving one sector and half serving a next adjacent sector.

In the aforementioned systems having at least two multi-sector antenna structures, each sector is served by multiple RRHs, and each RRH serves multiple adjacent sectors. This configuration provides both redundancy within the sector as well as diversity. Redundancy is achieved because failure of any one RRH will impact two adjacent sectors, but due to the cross-connection, each sector will still have at least half of its antennas served by the remaining operable RRH. Further, diversity may be achieved if the multi-sector structures are spaced properly to provide spatial diversity and/or each structure includes antennas that utilize cross-polarized elements. If the multi-sector structures are spaced properly to provide spatial diversity and each structure includes antennas that utilize cross-polarized elements then four-way diversity may be achieved. Further, since each multi-sector structure serves at least two sectors, the total number of structural enclosures is reducing by half, thus reducing cost and installation complexity while providing redundancy and diversity.

Figure 6:
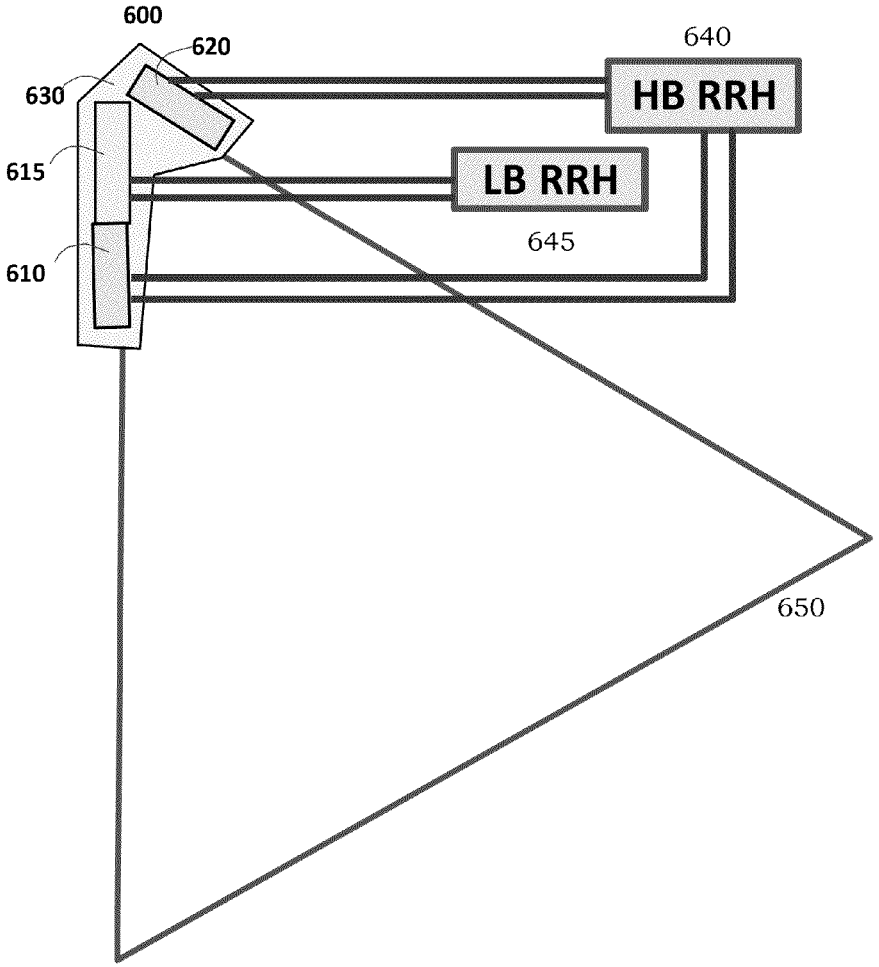
FIG. 6 illustrates a multi-band multi-sector antenna structure according to an example embodiment.

FIG. 6 illustrates a multi-band multi-sector antenna structure according to an example embodiment.

As shown in FIG. 6, the multi-band multi-sector antenna structure 600 includes at least a first high-band antenna 610, a low band antenna 615, a second high-band antenna 620 and a structural enclosure 630. The multi-band multi-sector antenna 600 may be mounted on a cellular boom 650. The first and second high-band antennas (610/620) have the same structure as the first antenna 410 and second antenna 420 and may be configured to serve 1,850-1,990 Mhz, also known as Personal Communications Service (PCS) band and Advanced Wireless Services (AWS) band. For instance, the first and second high-band antennas (610/620) are configured for both downlink transmission (to the UEs) and uplink reception of signals (from the UEs) in the high-band to support two adjacent sectors from one common location using a high band transceiver (640), for example, from a 'corner' where the two adjacent sectors meet.

The low-band antenna 615 may be configured to serve 698-894 MHz. The low-band antenna 615 is configured to provide both downlink transmission (to the UEs) and uplink reception (from the UEs) using signals in the low band using a low band transceiver 645. The multi-band multi-sector antenna structure 600 may include a single low-band antenna 615 that is either a linear dipole antenna or a dual polarization antenna. Thus, the multi-band multi-sector antenna structure 600 may not include low band elements that face both sectors from the corner, but rather may only support one sector (face) for the low band, because the spatial distance required to achieve sufficient diversity in the low-band frequency range may make it difficult to achieve spatial diversity. Therefore, each corner radome may support one sector (face) for the low band. By packaging the low band array along with both high band arrays, the packaging efficiency is increased, and overall size, weights, and costs are decreased as compared to deploying with separate high band and low band enclosures.

Figure 7:
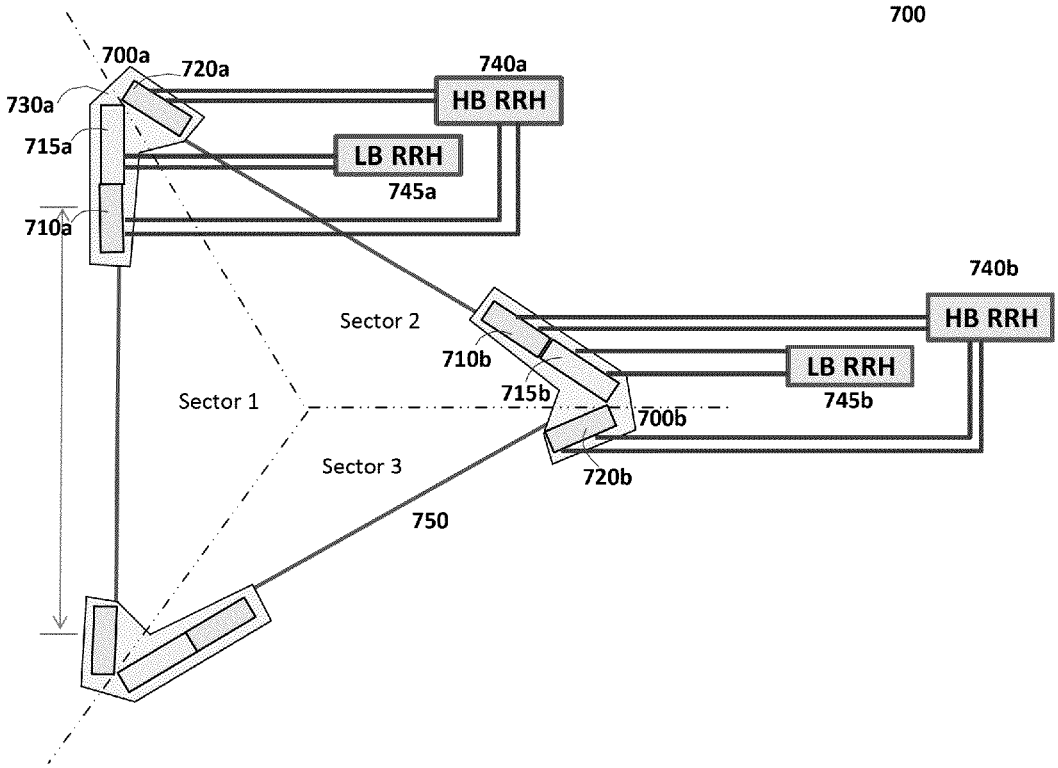
FIG. 7 illustrates an example embodiment of a system containing at least two multi-band multi-sector structures according to an example embodiment.

FIG. 7 illustrates an example embodiment of a system containing at least two multi-band multi-sector structures according to an example embodiment.

As shown in FIG. 7, a system 700 may include a cellular boom 750 and at least a first multi-band multi-sector antenna structure 700*a* and a second multi-band multi-sector antenna structure 700*b* mounted thereto. Each of the multi-band multi-sector antenna structures 700*a*/700*b* has a same structure as the multi-band multi-sector antenna structure 600. The first multi-band multi-sector antenna structure 700*a* includes a first high band RRH 740*a* that simultaneously serves at least a first sector (Sector 1) via a first high band antenna 710*a* and a second sector (Sector 2) via a second high band antenna 720*a*. Additionally, the first multi-band multi-sector antenna structure 700*a* includes a low band RRH 745*a* that serves one of the first and second sectors (e.g., Sector 1) via a low band antenna 715*a*.

The second multi-band multi-sector antenna structure 700*b* includes a second high band RRH 740*b* that simultaneously serves at least the second sector (Sector 2) via a first high band antenna 710*b* and a third sector (Sector 3) via a second high band antenna 720*b*. Additionally, the second multi-band multi-sector antenna structure 700*b* includes a low band RRH 745*b* that serves one of the second and third sectors (e.g, Sector 2) via a low band antenna 715*b*.

Additional multi-band multi-sector antenna structures may be similarly arranged in the system 700 adjacent to the at least two multi-band multi-sector antenna structures (700*a*/700*b*), with half of each structure's high-band antennas serving one sector and half serving a next adjacent sector.

Therefore, each of the multi-band multi-sector antenna structures 700*a*/700*b* contain at least two high band antenna arrays that each serve separate adjacent sectors and are both connected to the same high band RRH. Additionally, each of the multi-band multi-sector antenna structures 700*a*/700*b* include a low band antenna that serves one of the adjacent sectors and is connected to a low band RRH. If the signals are correctly sorted upstream, each high band RRH (740*a*/740*b*) can transmit/receive appropriate signals to/from two adjacent sectors and each low band RRH 745*a*/745*b* can transmit/receive signals from one of the adjacent sectors.

This results in each sector being served by at least two high-band RRHs and at least one low-band RRH, thus providing high-band redundancy and low band coverage in each of the sectors. For instance, the first sector is being served by the high-band RRH 740*a*, the high-band RRH 740*b* and the low-band RRH 745*a*.

Further, if each of the at least two multi-band multi-sector antenna structures 700*a*/700*b* are sufficiently spaced (e.g., seven to ten lambda λ) the multi-band multi-sector antenna structures 500*a*/500*b* may provide space diversity in the high-band within each sector. Likewise, if the antenna arrays in each of the at least two multi-band multi-sector antenna structures 700*a*/700*b* are cross-polarized antennas, polarization diversity in both the high-band and the low-band may be provided within each sector. If the multi-band multi-sector structures are spaced properly to provide spatial diversity and each structure 700*a*/700*b* includes high and antennas that utilize cross-polarized elements then four-way diversity may be achieved in the high band. However, in the low band, it is preferable to use polarization diversity in the low band and not Spatial diversity because low band antennas would require a large horizontal spatial separation to get appreciable diversity compared to the diversity achieved with the use of polarization diversity.

Each of the multi-band multi-sector antenna structures 700*a*/700*b* may have their respective RRHs integrated into the structure. For instance, the first multi-band multi-sector antenna structures 700*a* may have the first high band RRH 740*b* and the first low-band RRH 745*a* integrated in an enclosure 730*a*. Alternatively, each of the multi-band multi-cell antenna structures (700*a*/700*b*) may have ports on the surface of the enclosure to externally connect the RRHs thereto.

Figure 8:
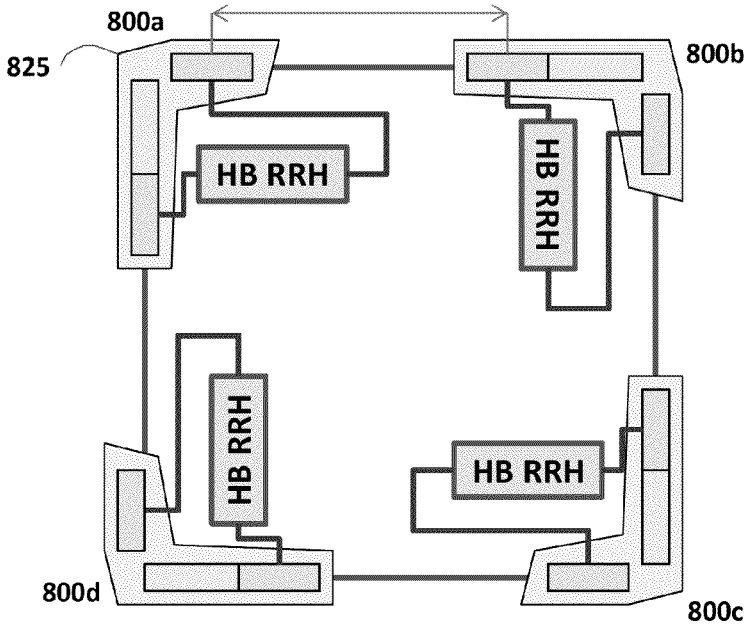
FIG. 8 illustrates a multiple sector cell-site antenna installation that is configured to serve four (4) sectors by utilizing multiple multi-band multi-sector antenna structures.
Figure 9:
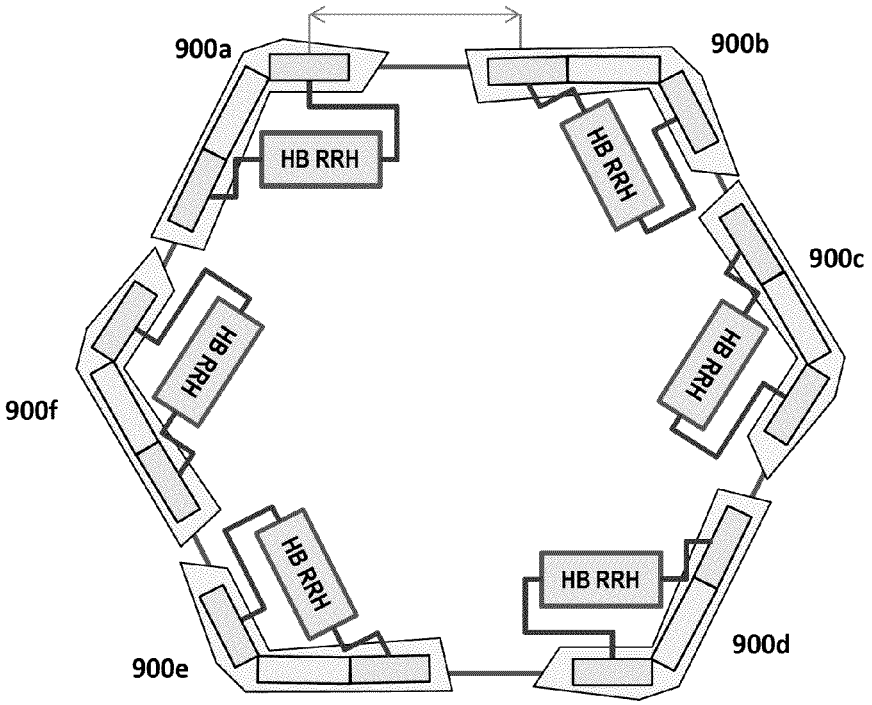
FIG. 9 illustrates a multiple sector cell-site antenna installation that is configured to serve six (6) sectors by utilizing multiple multi-band multi-sector antenna structures.

FIGS. 8 and 9 illustrate example embodiments of a multi-band multi-sector antenna structure for use in a cell divided into more than 3 sectors.

FIG. 8 illustrates four (4) multi-band multi-sector antenna structures 800*a*, 800*b*, 800*c* and 800*d* provided on a cellular boom. This configuration serves a four-sectored cell site where each sector covers 90 degrees rather than the 120 degrees covered by each multi-sector antenna structure in the three-sector cell configuration of FIGS. 1-5.

FIG. 9 illustrates six (6) multi-band multi-sector structures 900*a*, 900*b*, 900*c*, 900*d*, 900*e* and 900*f*. This configuration serves a six-sectored cell site where each sector covers 60 degrees. Each of the multi-band multi-cell antenna structures 800*a-d* and 900*a-f* have the same internal components as the multi-band multi-cell antenna structure 600 illustrated in FIG. 6. For instance, each of the multi-band multi-cell antenna structures 800*a-d*/900*a-f* are configured to serve two adjacent sectors and may provide antenna cross connect (ACC) between RRHs in the two adjacent sectors. The cross connected RRHs may be only for the high-band antennas or may be for both the high-band antennas and the low-band antennas. Further, the multi-band multi-cell antenna structures 800*a-d*/900*a-f* may provide high-band spatial diversity, if the structures are sufficiently spaced apart (e.g., seven to ten lambda λ). Likewise, the multi-band multi-cell antenna structures 800*a-d*/900*a-f* may provide high-band polarization diversity, if the high-band antenna arrays are cross-polarized and/or low band-polarization diversity, if the low band antenna arrays are cross-polarized. However, the multi-band multi-cell antenna structures 800*a-d*/900*a-f* have different angles between the antenna arrays as compared to the multi-band multi-cell antenna structures 800*a-d*/900*a-f*. The angle between the antenna arrays depends on how many sectors the cell is broken into. In a three (3) sector cell, having three (3) multi-cell antenna structures, such as illustrated in FIGS. 4-7, the angle between the antenna arrays may be 120 degrees. In a four (4) sector cell, having four (4) multi-cell antenna structures, such as illustrated in FIG. 8, the angle between the antenna arrays may be 90 degrees. Therefore, the angle between the antenna arrays in the multi-band multi-sector antenna structures 800*a-d* may be 90 degrees. In a six (6) sector cell having six (6) multi-cell antenna structures, such as illustrated in FIG. 9, the angle between the antenna arrays may be 60-degrees. Therefore, the angle between the antenna arrays in the multi-band multi-sector antenna structures 900*a-f* may be 60 degrees.

The multi-band multi-cell antenna structure may have a fixed angle between the first antenna array and second antenna array or alternatively the multi-band multi-cell antenna structure may have an adjustable angle between the first and second antenna arrays through an adjustable pivot 825 located on the enclosure (e.g. the Radome) at the intersection of the first and second antenna arrays.

While example embodiments have been particularly shown and described, it will be understood by one of ordinary skill in the art that variations in form and detail may be made therein without departing from the spirit and scope of the claims.

I claim:

1. A multiple sector cell-site antenna comprising:

a first antenna oriented to serve a first sector, the first antenna electrically connected to a first transceiver group;

a second antenna oriented to serve a second sector adjacent to the first sector and the second antenna electrically connected to the first transceiver group, the first antenna and the second antenna meeting to form a first corner;

a single enclosure covering both the first antenna and the second antenna; and a pivot point located on the single enclosure at the first corner, the pivot point configured to adjust an angle between the first antenna and the second antenna based on a number of sectors in the cell-site.

2. The multiple sector cell-site antenna of claim 1, wherein the first transceiver group is integrated in the single enclosure.

3. The multiple sector cell-site antenna of claim 1, wherein the single enclosure includes antenna input/output ports to connect the first antenna and the second antenna to the first transceiver group.

4. The multiple sector cell-site antenna of claim 1, wherein the first antenna and the second antenna are each an array of antenna elements.

5. The multiple sector cell-site antenna of claim 1, wherein the first transceiver group is a Remote Radio Head (RRH) and includes at least four ports, the first antenna is a first dual-polarized antenna electrically connected to two of the at least four ports, and the second antenna is a second dual-polarized antenna electrically connected to two of the at least four ports.

6. The multiple sector cell-site antenna of claim 1, wherein the first antenna and the second antenna are each one of an array of dual-polarized dual-slant antenna elements, an array of dual-polarized vertical/horizontal dipole antenna elements, and an array of dual-polarized right-hand/left-hand polarized antenna elements.

7. The multiple sector cell-site antenna of claim 1, wherein the pivot point is configured to adjust the angle between 60 and 120 degrees.

8. A multiple sector cell-site antenna system comprising:

a first multiple sector cell-site antenna including, a first antenna oriented to serve a first sector, the first antenna electrically connected to a first transceiver group;

a second antenna oriented to serve a second sector, the second sector adjacent to the first sector, the first antenna and second antenna meeting to form a first corner, and the second antenna electrically connected to the first transceiver group; and a first enclosure covering both the first antenna and the second antenna, the first enclosure including a first pivot point at the first corner, the first pivot point configured to adjust an angle between the first antenna and the second antenna based on a number of sectors in the cell-site; and a second multiple sector cell-site antenna including, a third antenna oriented to serve the first sector, the third antenna electrically connected to a second transceiver group;

a fourth antenna oriented to serve a third sector, the third antenna and fourth antenna meeting to form a second corner, and the fourth antenna electrically connected to the second transceiver group; and a second enclosure covering both the third antenna and the fourth antenna, the second enclosure including a second pivot point at the second corner, the second pivot point configured to adjust an angle between the third antenna and the fourth antenna based on the number of sectors in the cell-site.

9. The system of claim 8, wherein the first transceiver group is integrated in the first enclosure and the second transceiver group is integrated in the second enclosure.

10. The system of claim 8, wherein the first enclosure includes antenna input/output ports configured to connect the first antenna and the second antenna to the first transceiver group, and the second enclosure includes antenna input/output ports to connect the third antenna and the fourth antenna to the second transceiver group.

11. The system of claim 8, wherein each of the antennas are an array of antenna elements.

12. The system of claim 8, wherein the first multiple sector cell-site antenna and the second multiple sector cell-site antenna are spatially separated by a distance such that spatial diversity against fading is provided for the first sector.

13. The system of claim 8, wherein the first transceiver group is a first remote radio read (RRH) and the second transceiver group is a second RRH and each RRH each include at least four ports, the first antenna is a first polarized antenna electrically connected to two of the at least four ports of the first RRH, the second antenna is a second polarized antenna electrically connected to two of the at least four ports of the first RRH, the third antenna is a third polarized antenna electrically connected to two of the at least four ports of the second RRH, and the fourth antenna is a fourth polarized antenna electrically connected to two of the at least four ports of the second RRH.

14. The system of claim 8, wherein the first antenna that is connected to the first transceiver group and third antenna that is connected to the second transceiver group together utilize antenna cross connect to provide redundancy and diversity to the first sector.

15. A multiple-band multiple-sector cell-site antenna comprising:

a first high-band antenna configured to utilize a first radio wave band and oriented to serve a first sector, the first high-band antenna electrically connected to a first high-band transceiver group;

a second high-band antenna configured to utilize the first radio wave band and oriented to serve a second sector adjacent to the first sector, the second high-band antenna electrically connected to the first high-band transceiver group;

a first low-band antenna configured to utilize a low radio wave band and oriented to serve the first sector, the low-band antenna electrically connected to a low-band transceiver group; and a single enclosure covering the first high-band antenna, the second high-band antenna, and the first low-band antenna.

16. The multiple-sector cell-site antenna of claim 15, wherein each of the antennas are an array of dual-polarized antenna elements that provide two-way diversity for at least one of uplink reception of signals and downlink transmission of signals.

* * * * *